US009406461B2

(12) United States Patent
Liang

(10) Patent No.: US 9,406,461 B2
(45) Date of Patent: Aug. 2, 2016

(54) DEMONSTRATION SWITCH STRUCTURE OF LAMP

(71) Applicant: Qinghui Liang, Fujian Province (CN)

(72) Inventor: Qinghui Liang, Fujian Province (CN)

( * ) Notice: Subject to any disclaimer, the term of this patent is extended or adjusted under 35 U.S.C. 154(b) by 166 days.

(21) Appl. No.: 14/076,266

(22) Filed: Nov. 11, 2013

(65) Prior Publication Data

US 2015/0053538 A1 Feb. 26, 2015

(30) Foreign Application Priority Data

Aug. 22, 2013 (CN) ..... 2013 2 0517660 U

(51) Int. Cl.

| | |
|---|---|
| ***B65D 85/00*** | (2006.01) |
| ***H01H 13/06*** | (2006.01) |
| ***H01H 21/22*** | (2006.01) |
| ***F21V 23/04*** | (2006.01) |
| ***H01H 13/10*** | (2006.01) |
| *F21W 131/405* | (2006.01) |
| *F21Y 101/02* | (2006.01) |

(52) U.S. Cl.

CPC *H01H 13/06* (2013.01); *F21S 4/10* (2016.01); *F21V 23/04* (2013.01); *H01H 13/10* (2013.01); *H01H 21/22* (2013.01); *F21W 2131/405* (2013.01); *F21Y 2101/02* (2013.01); *H01H 2223/002* (2013.01)

(58) Field of Classification Search

CPC ..... F21L 4/00; F21L 7/00; F21V 23/0414; H01H 13/06; H01H 21/22; H01H 13/10

USPC ..... 206/320, 569; 200/43.07, 302.2, 303, 200/297, 50.18, 51.16, 277.2, 299; 362/157, 185, 189

See application file for complete search history.

(56) References Cited

U.S. PATENT DOCUMENTS

| | | | | |
|---|---|---|---|---|
| 3,871,520 | A * | 3/1975 | Hand | 206/320 |
| 2002/0106624 | A1* | 8/2002 | Chan | 434/393 |
| 2004/0160225 | A1* | 8/2004 | Kung | G01R 31/3627 324/447 |
| 2007/0019402 | A1* | 1/2007 | Dalton et al. | 362/157 |
| 2011/0007499 | A1* | 1/2011 | Bologeorges | 362/183 |

* cited by examiner

*Primary Examiner* — Jacob K Ackun
*Assistant Examiner* — Rafael Ortiz

(57) ABSTRACT

The present utility model discloses a demonstration switch structure of a lamp, comprising: a demonstration test switch which is fixedly installed on a battery case of the lamp, and a mechanical press control device which is fixedly installed on the battery case of the lamp and capable of movably pressing a control terminal of the demonstration test switch, wherein a control component of the mechanical press control device extends to a switch window of a packing box of the lamp. The present utility model has the following advantageous effects: the packing cost is reduced greatly, the hidden danger of electric leakage due to contact of a pluggable wire in the conventional demonstration switch structure with water is eliminated, and the hidden danger of short circuit of a lamp set is eliminated.

3 Claims, 2 Drawing Sheets

DEMONSTRATION SWITCH STRUCTURE OF LAMP

BACKGROUND OF THE INVENTION

The present utility model relates to an accessory of a lamp, and particularly to a demonstration switch structure of a lamp.

In festivals such as Christmas day, Spring Festival, and National Day, in order to enhance the festival atmosphere, people usually installs some lamp sets in housings for heightening the atmosphere of happy festivals. The existing lamp set generally includes a lamp string and a power supply for supplying power to the lamp string. The lamp string includes several light emitting bodies connected in series or in parallel. The power supply includes a battery case, and a solar panel, a charge/discharge controller and a chargeable battery which are electrically connected in turn. The solar panel is installed on an outer surface of the battery case, the charge/discharge controller and the chargeable battery are installed within the battery case, and an outer wall of the battery case is provided with a use control switch for controlling the turning ON or OFF of the lamp string. During use, a long lamp string is winded on a fixed object such as a tree, a roof or a table, then the use control switch is activated such that the power supply supplies power to the lamp string, and each of the light emitting bodies of the lamp string lights up, thereby enhancing the festive atmosphere to the environment. Adopting the power supply at the same time has the advantages of energy-saving and environmental protection. However, such a lamp set is packed in a sealed manner by a packing box when being sold in a supermarket, thus the purchaser can not turn on the power to watch the operating effect of the lamp string, which reduces the desire for buying of the purchaser; or if the purchaser unpacks the package and turns on the power forcedly for watching, the package will be damaged, which is one of the most common phenomena of man-made sabotage to the commodities for sale in the supermarket.

In order to solve the above problems, the manufacturers develop a kind of lamp set which can demonstrate the illumination effect without unpacking the package. That is, a demonstration switch structure, which includes a demonstration test switch for demonstration and a pluggable wire, is added in the power supply device additionally. The demonstration test switch is a press-type normally open test switch which is separately provided with respect to the battery case of the lamp set. A first end of the pluggable wire is electrically connected to a controller of the charge/discharge controller. A second end of the pluggable wire protrudes out of the battery case, and is provided with an electrical outlet. The electrical outlet is electrically plugged with an electrical component, which comprises a plug at a first end for electrically plugging with the electrical outlet, and a connecting wire at a second end for connecting to the press-type normally open test switch. Meanwhile, there is a transparent area on a portion of the packing box of the lamp for packing the lamp set corresponding to the lamp set, and a switch window for pressing the demonstration test switch by the purchaser is provided at a portion of the packing box corresponding to the demonstration test switch. In this way, the purchaser can directly contact and press all the time the demonstration test switch through the switch window, so that the demonstration test switch is turned on. In this case, the lamination effect of the lamp string can be watched through the transparent area, which facilitates the purchase of the purchaser.

However, since such a demonstration test switch of the lamp set is separately provided with the battery case, and the purchaser directly contacts the demonstration test switch, a hard object is needed to fixedly support the demonstration test switch when being pressed, such that the demonstration test switch can be turned on. For this, it is required to additionally dispose a pulp box for accommodating the lamp string and the battery case therein and for fixedly installing the demonstration test switch when packing the lamp set, which undoubtedly increases the packing cost. Meanwhile, the pluggable wire is fixedly connected with the battery case, and the electrical outlet of the pluggable wire is exposed at the outside of the battery case. In this case, the pluggable wire which cooperates with the demonstration test switch can not be dismantled after unpacking the lamp set, but remain on the battery case. As a result, the hidden danger of electric leakage when contacting with water is presented in the electrical outlet of the pluggable wire, and thus there is a hidden danger of short circuit of the lamp set.

BRIEF SUMMARY OF THE INVENTION

The object of the present utility model is to provide a demonstration switch structure of a lamp which can solve the problem of high packing cost due to the necessity of cooperation between the demonstration test switch and the pluggable wire of the battery case and the problem of the hidden danger of short circuit of the lamp string.

The technical solution of the present utility model provides a demonstration switch structure of a lamp, which comprises: a demonstration test switch which is fixedly installed on a battery case of the lamp, and a mechanical press control device which is fixedly installed on the battery case of the lamp and capable of movably pressing a control terminal of the demonstration test switch, wherein a control component of the mechanical press control device extends to a switch window of a packing box of the lamp.

The demonstration test switch is installed within the battery case of the lamp, the control terminal of the demonstration test switch protrudes out of a bottom surface of the battery case of the lamp, and a waterproof sleeve is sleeved on an outside of the control terminal of the demonstration test switch.

The mechanical press control device comprises a balance bar and a hinge base, the hinge base is fixed to the bottom surface of the battery case of the lamp, the balance bar lies on and is movably hinged to the hinge base, a first end of the balance bar is located below the control terminal of the demonstration test switch and is provided with a control head extending upward to the control terminal of the demonstration test switch, a second end of the balance bar extends out of the bottom surface of the battery case of the lamp and is provided with a manipulation bar extending upward and being perpendicular to the balance bar, the manipulation bar is arranged adjacent to the battery case of the lamp, and an upper end of the manipulation bar is located below the switch window of the packing box of the lamp.

A portion of the balance bar at which the balance bar is hinged to the hinge base is used as a hinge part, a bottom surface of the hinge base is concavely provided with an installing groove for movably accommodating the hinge part of the balance bar, two side walls of the hinge part are convexly provided with a rotation shaft respectively, and a groove wall of the installing groove is provided with two rotation shaft installing holes into which the two rotation shafts are correspondingly clipped.

An opening for sliding the rotation shafts into the rotation shaft installing holes is provided at a portion in the groove wall of the installing groove corresponding to the rotation shaft installing holes, and the opening is an oblique opening inclining upward from inside to outside.

In the demonstration switch structure of the lamp of the present utility model having the above technical solutions, the demonstration test switch is installed within the battery case of the lamp, thus it is unnecessary to provide an additional pulp box for fixedly installing the demonstration test switch in the packing box when packing the demonstration switch structure, which greatly reduces the packing cost. Meanwhile, the turn-on of the demonstration test switch can be controlled by the mechanical press control device without an additional pluggable wire having an electrical outlet exposing to outside, and the mechanical press control device is a pure connection structure without any electrical connection device, thereby the hidden danger of electric leakage due to contact of the pluggable wire in the conventional demonstration switch structure with water is eliminated, and thus the hidden danger of short circuit of the lamp string is eliminated. In addition, since an opening for sliding the rotation shaft into the rotation shaft installing hole is provided at a portion in the groove wall of the installing groove corresponding to the rotation shaft installing hole, and the opening is an oblique opening inclining upward from inside to outside, it is convenient to disassemble the balance bar through the opening.

DETAILED DESCRIPTION OF THE INVENTION

Figure 1:
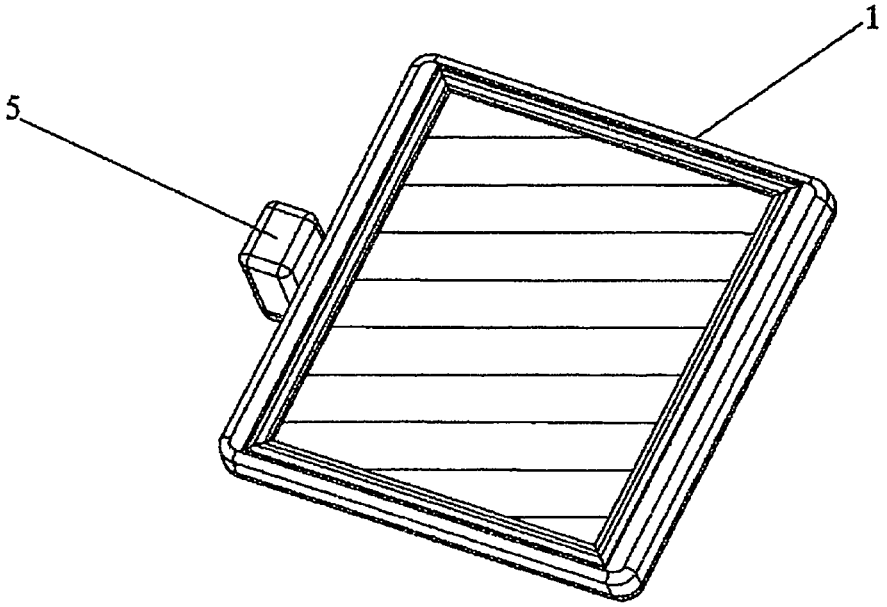
FIG. 1 is a front view of a demonstration switch structure of a lamp according to the present utility model.
Figure 2:
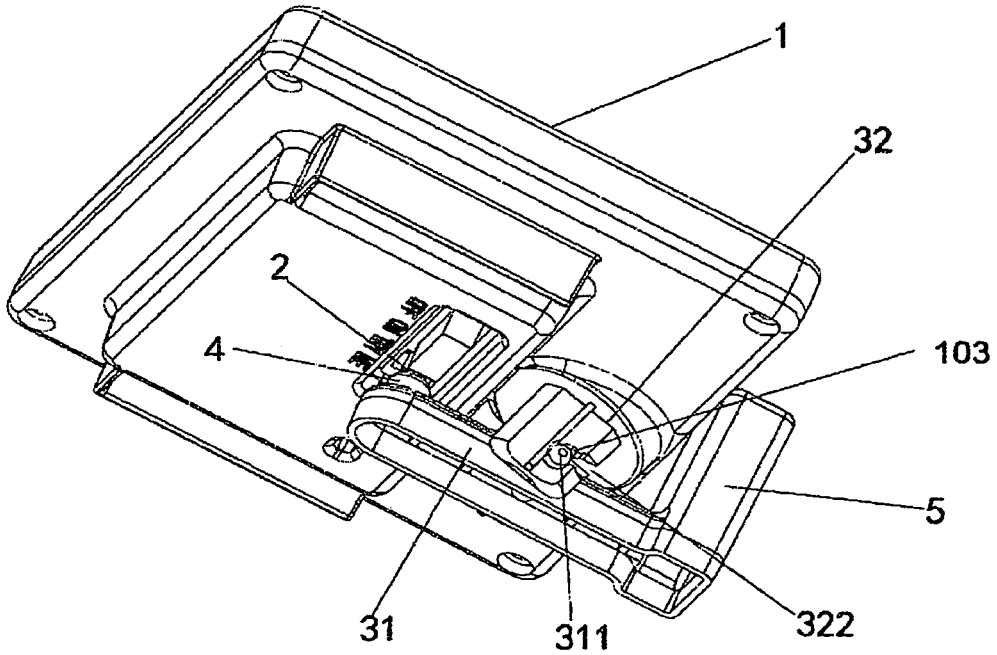
FIG. 2 is a rear view of the demonstration switch structure according to the present utility model.
Figure 3:
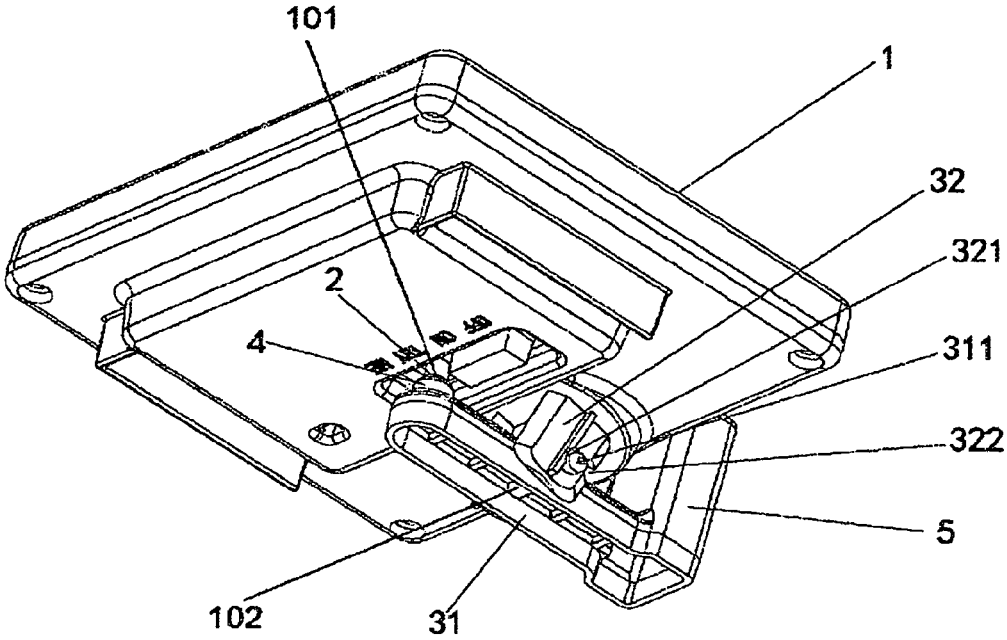
FIG. 3 is a rear view from another angle of the demonstration switch structure according to the present utility model.
Figure 4:
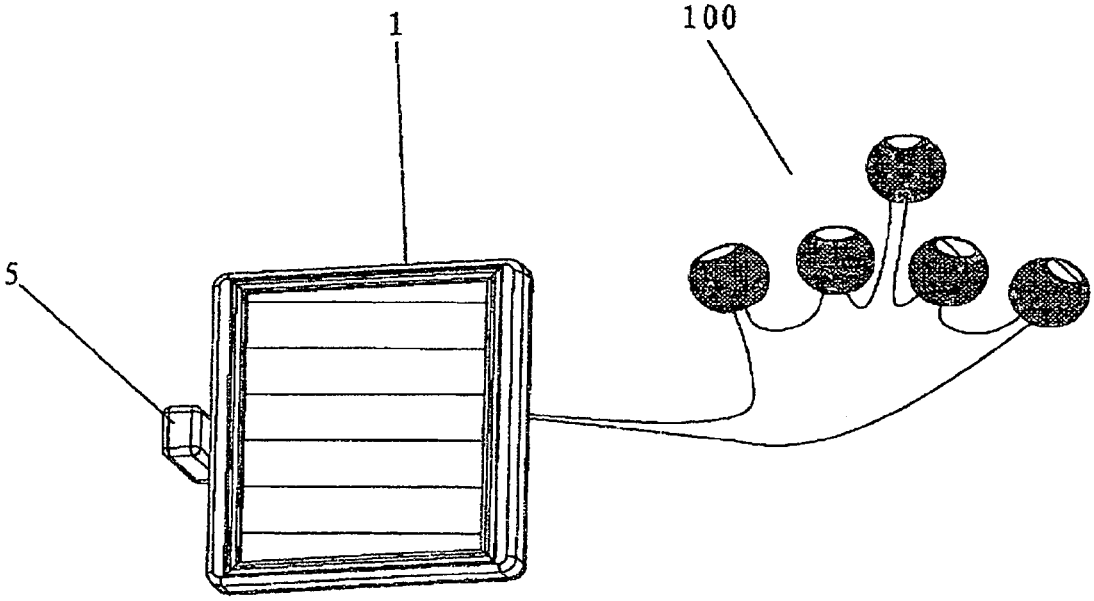
FIG. 4 is a view showing a state in which the demonstration switch structure according to the present utility model is combined with a lamp string.

As shown in FIGS. 1-4, a demonstration switch structure of a lamp in the present utility model includes a demonstration test switch 2 which is installed on a battery case 1 of the lamp, and a mechanical press control device which is fixedly installed on the battery case 1 of the lamp and capable of movably pressing a control terminal 101 of the demonstration test switch 2. The control terminal of the demonstration test switch 2 protrudes out of a bottom surface of the battery case 1 of the lamp. The demonstration test switch 2 is a press-type normally open test switch. The mechanical press control device is installed on the bottom surface of the battery case 1 of the lamp, and a control component of the mechanical press control device extends to a switch window of a packing box of the lamp.

The mechanical press control device includes a balance bar 31 and a hinge base 32. The hinge base 32 is fixed to the bottom surface of the battery case 1. The balance bar 31 lies on and is movably hinged to the hinge base 32. That is, a portion of the balance bar 31 at which the balance bar 31 is hinged to the hinge base 32 is used as a hinge part, and a bottom surface of the hinge base 32 is concavely provided with an installing groove 102 for movably accommodating the hinge part of the balance bar 31. Two side walls of the hinge part are convexly provided with a rotation shaft 311 respectively, and a groove wall 103 of the installing groove is provided with two rotation shaft installing holes 321 into which the two rotation shafts 311 are correspondingly clipped. Moreover, a first end of the balance bar 31 is located below the control terminal of the demonstration test switch 2 and is provided with a control head 4 extending upward to the control terminal of the demonstration test switch 2. A second end of the balance bar 31 extends out of the bottom surface of the battery case 1 of the lamp and is provided with a manipulation bar 5 extending upward and being perpendicular to the balance bar 31. The manipulation bar 5 is arranged adjacent to the battery case 1 of the lamp, and an upper end of the manipulation bar 5 is located below the switch window of the packing box of the lamp.

In the demonstration switch structure of the lamp in the present utility model, the connection between the balance bar 31 and the hinge base 32 is achieved by the cooperation of the rotation shafts 311 and the rotation shaft installing holes 321, and a lever structure may be constituted by the balance bar 31, the hinge base 32, the rotation shafts 311 and the rotation shaft installing holes 321. Since the demonstration test switch 2 and the battery case 1 of the lamp are packed together when being packed such that the battery case 1 of the lamp fixedly supports the demonstration test switch 2, it is unnecessary to provide an additional pulp box for fixedly installing the demonstration test switch in the packing box when packing the demonstration switch structure, which greatly reduces the packing cost. Meanwhile, if the purchaser wants to watch the lamp string in an illumination state before purchase, she/he only needs to press down the upper end of the manipulation bar 5 through the switch window of the packing box. In this case, a downward force of the manipulation bar 5 acts on the second end of the balance bar 31 to make the second end of the balance bar 31 move downward, the downward movement of the balance bar 31 makes the first end of the balance bar 31 move upward by the lever principle, which may make the control head 4 rise so as to be contacted with the control terminal of the demonstration test switch 2 and press upward the control terminal of the demonstration test switch 2, thereby turning on the demonstration test switch 2 to supply power to the lamp string 100 by a power supply of the lamp, and thus lighting up the lamp string 100. The turn-on of the demonstration test switch 2 can be controlled by the mechanical press control device without an additional pluggable wire having an electrical outlet exposing to outside, and the mechanical press control device is a pure connection structure without any electrical connection device, thereby the hidden danger of electric leakage due to contact of the pluggable wire in the conventional demonstration switch structure with water can be eliminated, and thus the hidden danger of short circuit of the lamp string can be eliminated.

In the present utility model, a waterproof sleeve (not shown in drawings) may be sleeved on the outside of the demonstration test switch 2, thus the demonstration test switch 2 is waterproof by the waterproof sleeve.

In the present utility model, an opening 322 for sliding the rotation shaft 311 into the rotation shaft installing hole 321 is provided at a portion in the groove wall of the installing groove corresponding to the rotation shaft installing hole 321, and the opening 322 is an oblique opening inclining upward from inside to outside. Thus, it is convenient to disassemble the balance bar 31 from the hinge base 32 through the opening 322, which prevents the balance bar 31 from affecting the good looking of the whole lamp string when normally using the lamp string. Meanwhile, since the opening 322 is an oblique opening inclining upward from inside to outside, the rotation shaft 11 is not prone to be disengaged from the rotation shaft installing hole 321 through the opening 322, i.e., the opening 322 plays a function of limitation and fixation.

It is not intend to limit that the demonstration switch structure of the lamp in the present utility model can only be applied to the lamp set, but also can be applied to any light emitting lamp.

What is claimed is:

1. A demonstration switch structure of a lamp, characterized in that the demonstration switch structure comprises:

a demonstration test switch which is fixedly installed on a battery case of the lamp, and a mechanical press control device which is fixedly installed on the battery case of the lamp and capable of movably pressing a control terminal of the demonstration test switch, the demonstration test switch is installed within the battery case of the lamp, the control terminal of the demonstration test switch protrudes out of a bottom surface of the battery case of the lamp;

the mechanical press control device comprises a balance bar and a hinge base, the hinge base is fixed to the bottom surface of the battery case of the lamp, the balance bar lies on and is movably hinged to the hinge base, a first end of the balance bar is located below the control terminal of the demonstration test switch and is provided with a control head extending upward to the control terminal of the demonstration test switch, a second end of the balance bar extends out of the bottom surface of the battery case of the lamp and is provided with a manipulation bar extending upward and being perpendicular to the balance bar, the manipulation bar is arranged adjacent to the battery case of the lamp.

2. The demonstration switch structure of the lamp as claimed in claim 1, characterized in that a portion of the balance bar at which the balance bar is hinged to the hinge base is used as a hinge part, a bottom surface of the hinge base is provided with an installing groove for movably accommodating the hinge part of the balance bar, two side walls of the hinge part are convexly provided with a rotation shaft respectively, and a groove wail of the installing groove is provided with two rotation shaft installing holes into which the two rotation shafts are correspondingly clipped.

3. The demonstration switch structure of the lamp as claimed in claim 2, characterized in that an opening for sliding the rotation shafts into the rotation shaft installing holes is provided at a portion in the groove wall of the installing groove corresponding to the rotation shaft installing holes, and the opening is an oblique opening inclining upward from inside to outside.

* * * * *